US010364571B1

(12) United States Patent
Moghaddam

(10) Patent No.: US 10,364,571 B1
(45) Date of Patent: Jul. 30, 2019

(54) LIGHTWEIGHT STRUCTURAL PANEL

(71) Applicant: Morteza Moghaddam, Waban, MA (US)

(72) Inventor: Morteza Moghaddam, Waban, MA (US)

( * ) Notice: Subject to any disclaimer, the term of this patent is extended or adjusted under 35 U.S.C. 154(b) by 0 days.

(21) Appl. No.: 15/867,976

(22) Filed: Jan. 11, 2018

(51) Int. Cl.

| | |
|---|---|
| ***E04B 2/56*** | (2006.01) |
| ***E04B 2/62*** | (2006.01) |
| ***E04B 2/84*** | (2006.01) |
| ***E04C 2/20*** | (2006.01) |
| ***E04C 2/38*** | (2006.01) |
| ***E04C 3/04*** | (2006.01) |
| ***E04C 2/284*** | (2006.01) |

(52) U.S. Cl.
CPC ..... *E04C 2/284* (2013.01); *E04B 2/562* (2013.01); *E04B 2/62* (2013.01); *E04B 2/845* (2013.01); *E04C 2/205* (2013.01); *E04C 2/384* (2013.01); *E04C 2003/0491* (2013.01)

(58) Field of Classification Search
CPC ..... E04C 2/284; E04C 2/384; E04C 2/205; E04C 2003/0491; E04B 2/562; E04B 2/62; E04B 2/845
See application file for complete search history.

(56) References Cited

U.S. PATENT DOCUMENTS 3,530,631 A * 9/1970 Guddal ..... E04B 2/58 52/414
3,992,835 A 11/1976 Saveker
4,104,842 A * 8/1978 Rockstead ..... E04B 2/8617 52/309.12
4,297,820 A * 11/1981 Artzer ..... B29C 69/001 29/446
4,494,349 A 1/1985 Clements
4,611,450 A * 9/1986 Chen ..... E04O 2/22 428/222
4,614,013 A 9/1986 Stevenson
4,735,355 A 4/1988 Browning
5,079,890 A 1/1992 Kubik et al.
5,207,045 A * 5/1993 Bodnar ..... E04B 1/161 264/31
D374,292 S 10/1996 Koo
5,592,848 A * 1/1997 Bodnar ..... E04B 1/161 29/415
6,644,535 B2 * 11/2003 Wallach ..... B21F 27/128 228/173.5
7,563,497 B2 * 7/2009 Ma ..... E04C 2/34 428/116
8,343,398 B2 * 1/2013 Khatchikian ..... E04C 2/044 264/261
9,347,221 B2 5/2016 Vichniakov
9,371,650 B2 * 6/2016 Linares, III ..... E04C 2/288
(Continued)

FOREIGN PATENT DOCUMENTS

GB 2479649 A * 10/2011 ..... E04B 1/161

*Primary Examiner* — Rodney Mintz
(74) *Attorney, Agent, or Firm* — Bay State IP, LLC

(57) ABSTRACT

A structural panel for building construction includes a series of truss members, and accompanying sinusoidal support elements in welded communication and enclosed in a planarly extended foam layer. Together, the structural panel allows for easy and efficient off-site assembly, which creates a lightweight panel with an increased weight-bearing capacity using inexpensive and versatile materials.

10 Claims, 7 Drawing Sheets

(56) References Cited

U.S. PATENT DOCUMENTS

| | | | | |
|---|---|---|---|---|
| 2001/0010140 | A1* | 8/2001 | Ritter | E04C 2/044 52/649.1 |
| 2002/0020134 | A1 | 2/2002 | Collard | |
| 2002/0043045 | A1 | 4/2002 | Del Din | |
| 2003/0136071 | A1* | 7/2003 | Kobayashi | E04B 1/043 52/414 |
| 2005/0284088 | A1* | 12/2005 | Heath | E04B 2/845 52/741.1 |
| 2007/0039276 | A1* | 2/2007 | Sorensen | E04C 5/0627 52/633 |
| 2008/0155919 | A1* | 7/2008 | Keshishian | E04C 2/044 52/309.11 |
| 2008/0184663 | A1* | 8/2008 | Martirossyan | B29C 44/1276 52/745.19 |
| 2008/0196349 | A1* | 8/2008 | Gonzalez | E04B 2/845 52/653.1 |
| 2009/0056256 | A1* | 3/2009 | Blomquist, Jr. | E04B 2/845 52/309.8 |
| 2010/0300026 | A1 | 12/2010 | Candiracci | |
| 2013/0266793 | A1* | 10/2013 | Robertshaw | E04B 2/845 428/223 |
| 2015/0132535 | A1* | 5/2015 | Hazenbrink | E04B 2/84 428/137 |
| 2015/0191909 | A1* | 7/2015 | Linares, III | E04C 2/288 52/309.11 |
| 2016/0208476 | A1* | 7/2016 | Wadley | C23C 8/22 |
| 2016/0290030 | A1* | 10/2016 | Collins | E04B 5/36 |
| 2017/0051506 | A1* | 2/2017 | An | E04F 15/18 |
| 2019/0017269 | A1* | 1/2019 | Holt | E04C 3/291 |
| 2019/0055732 | A1* | 2/2019 | Gil | E04B 2/86 |

* cited by examiner

LIGHTWEIGHT STRUCTURAL PANEL

BACKGROUND OF THE INVENTION

Field of the Invention

The present invention relates generally to a panel for use in the construction of a building, and more particularly to a lightweight structural panel that utilizes a space frame assembly with a pair of truss members arranged in a longitudinal direction and a plurality of sinusoidal support members arranged in a lateral direction with a lightweight foam filler layer and outer skin.

Description of the Related Art

A known type of construction method for load-bearing side walls is the sandwich panel in which prefabricated panels separated by perpendicular elements are filled with concrete. In certain embodiments mesh made of metal is inserted between the panels which offers additional reinforcement and support. The creation of these panels requires a great deal of equipment and time which is undesirable in the manufacturing process. Furthermore, increased labor costs often occur in order to produce panels in this manner.

Another common type of panel construction includes modular wall panels that can be prefabricated and connected in a specific order in order to construct the building. These wall panels have been constructed of wood, concrete, foamed material, and plastic, to name a few. None of these materials is ideal, however, as concrete is extremely heavy and foam is too light to support a necessary weight load. Reinforcing the panels with steel requires more time and money to weld the reinforcement rods in the required form. Panels have also been made of heavy materials that make it difficult to construct off-site and to transport.

Historically, it was also been difficult to produce a load bearing wall that also has a finished exterior as the wall panel needs to be able to receive wiring, duct work, and plumbing. Either the panels have been made without enough space for the necessary additions or they are produced without a finished exterior in order to add the wiring and pipes after installation.

SUMMARY OF INVENTION

The instant series of system and apparatuses, as illustrated herein, are clearly not anticipated, rendered obvious, or even present in any of the prior art mechanisms, either alone or in any combination thereof. The instant versatile systems (which combine lightweight materials and superior performance, in conjunction with increased weight bearing capabilities) and series of devices introduce a structural panel for building construction clearly surpassing what is available in the marketplace.

A primary object of the instant invention is to provide a structural panel that is easy to assemble and lightweight with the ability to support an increased weight load. Thus, the several embodiments of the instant invention are illustrated herein.

In one aspect, the present invention introduces a modular precast lightweight structural panel that may be carried by an individual for use in building construction as a structural load bearing member or alternatively as part of a nonstructural partition wall, floor and/or roof.

Another aspect of the present invention introduces a structural panel, which comprises a pair of truss members and a plurality of sinusoidal support members, wherein the truss members are welded to the plurality of sinusoidal support members, and wherein the structural panel is covered by a planarly extended outer skin, and provides an inexpensive, easy, and effective means for creating a structural panel for a building construction.

In an additional aspect, the present invention introduces a structural panel that is made of lightweight material.

In an additional aspect, the present invention introduces a structural panel that has an increased load-bearing capacity.

In one aspect, the present invention introduces a structural panel that is lightweight and easy to assemble for the purpose of off-site assembly and easy transfer to the building project.

Another aspect of the present invention is a construction that allows for easy insertion of utilities without the need to cut the exterior or to repair the exterior after installation of the panels.

Yet another aspect of the present invention is to provide a lightweight structural panel that possesses high processing capabilities including resistance to heat, fire, moisture, noise and rodents.

In yet another aspect of the present invention, a lightweight structural panel is versatile in design to be arranged as a load bearing wall, horizontally as a floor structural panel or on an angle as a roof structural panel.

These together with other objects of the system and apparatus, along with the various features of novelty, which characterize the system and apparatus, are pointed out with particularity in the claims annexed to and forming a part of this disclosure. For a better understanding of the system, its operating advantages and the specific objects attained by its uses, reference should be made to the accompanying drawings and descriptive matter in which there are illustrated several embodiments of the system.

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

DETAILED DESCRIPTION OF THE SEVERAL EMBODIMENTS

The detailed description set forth below in connection with the appended drawings is intended as a description of presently exemplary embodiments of the apparatus and does not represent the only forms in which the present apparatus may be constructed and/or utilized. The description sets forth the functions and the sequence of steps for constructing and operating the apparatus in connection with the illustrated embodiments. However, it is to be understood that the same or equivalent functions and sequences may be accomplished by different embodiments that are also intended to be encompassed within the spirit and scope of the invention.

Figure 1:
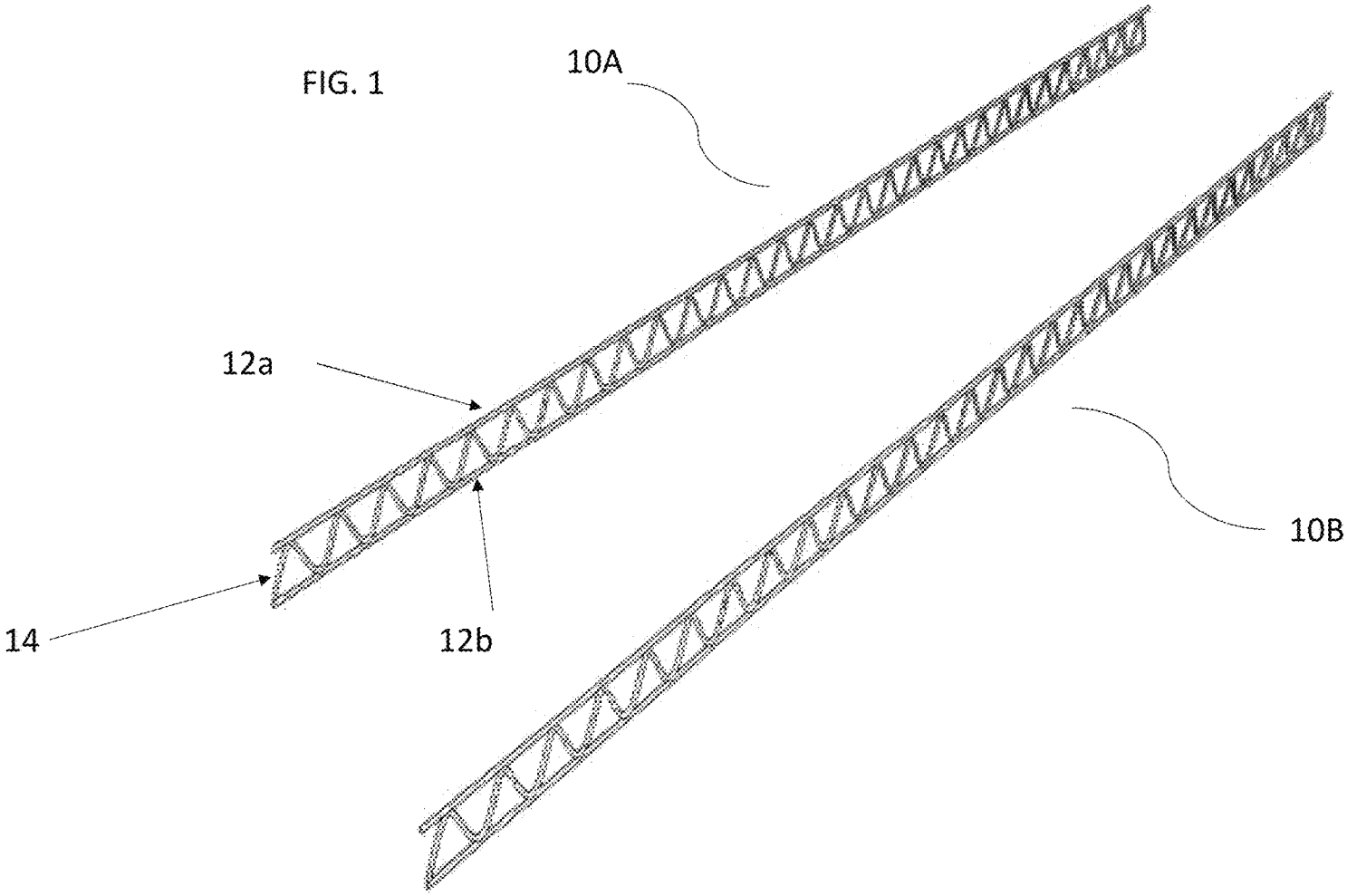
FIG. 1 illustrates a perspective view of a pair of truss members.

FIG. 1 illustrates a pair of truss members 10A and 10B for use with a structural panel 100 (see FIG. 7), wherein each truss member 10A and 10B comprises a top support member 12A and a bottom support member 12B. In this embodiment, a sinusoidal element 14 extends along a length of the top and bottom support members 12A and 12B of each truss member 10A and 10B. Furthermore, each sinusoidal element 14 is welded to the top and bottom support members 12A and 12B where they come into physical contact with each other.

Figure 2:
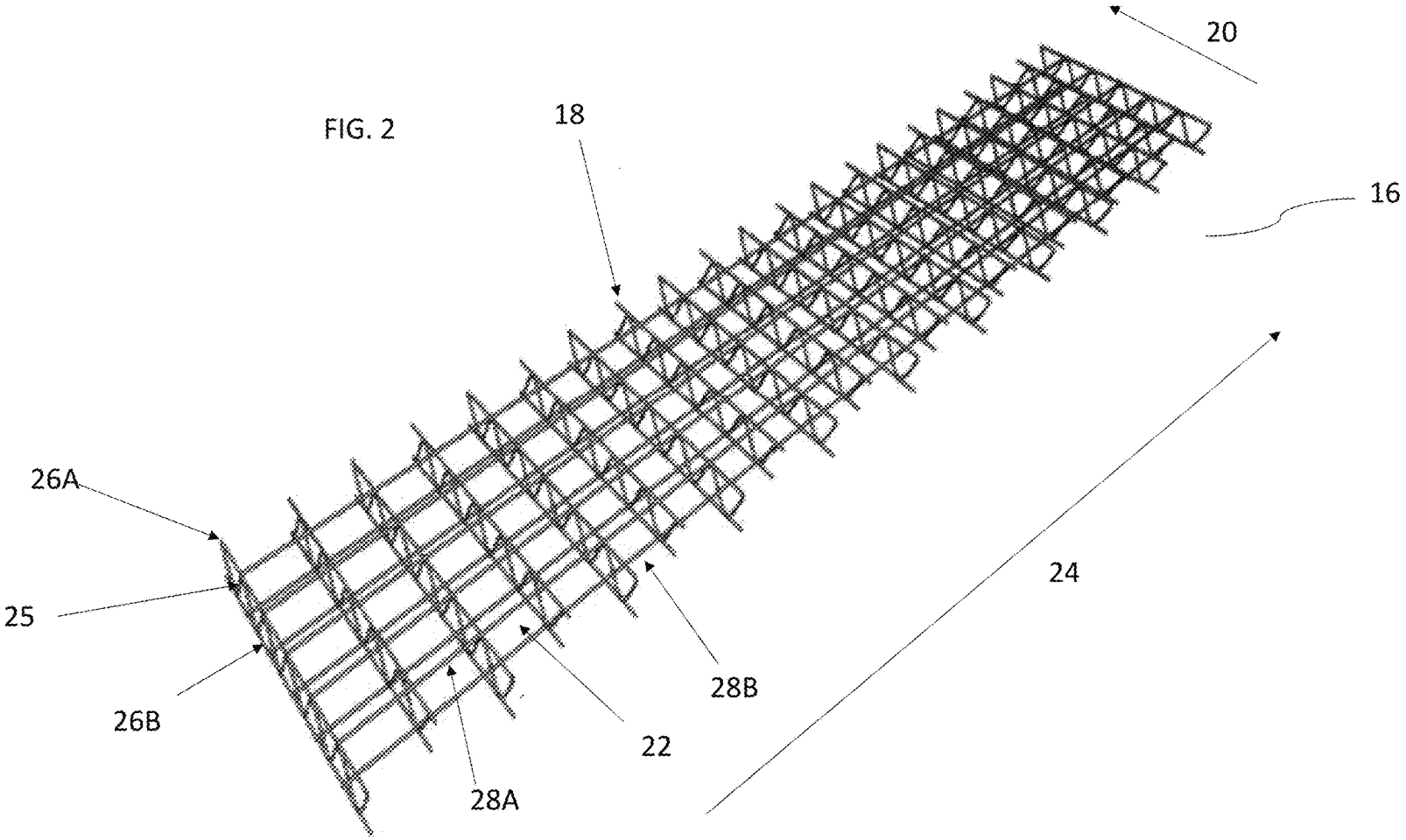
FIG. 2 illustrates a perspective view of one embodiment of a space frame that is enclosed by the pair of truss members having a plurality of sinusoidal support members and plurality of opposing reinforcing elements at a top and a bottom of the sinusoidal support members.

FIG. 2 illustrates one embodiment of a space frame assembly 16 for use in the construction of the structural panel 100. In this embodiment, the space frame assembly 16 comprises a plurality of sinusoidal support members 18 arranged in a lateral direction 20 and a plurality of opposing reinforcing elements 22 arranged in a longitudinal direction 24 and in a perpendicular orientation to the plurality of sinusoidal support members 18.

In this embodiment, the sinusoidal support member 18 comprises a top support member 26A and a bottom support member 26B. Additionally, a sinusoidal element 25 extends along a length of the top and bottom support members 26A and 26B of each sinusoidal support member 18. Furthermore, each sinusoidal element 25 is welded to the top and bottom support members 26A and 26B where they come into physical contact with each other.

In this embodiment, each reinforcing element 22 comprises a top reinforcing element 28A and a bottom reinforcing element 28B, wherein each top reinforcing element 28A is in mechanical communication via welding with each top support member 26A of each sinusoidal support member 18. Correspondingly, each bottom reinforcing element 28B is in mechanical communication via welding with each bottom support member 26B of each sinusoidal support member 18.

Figure 3:
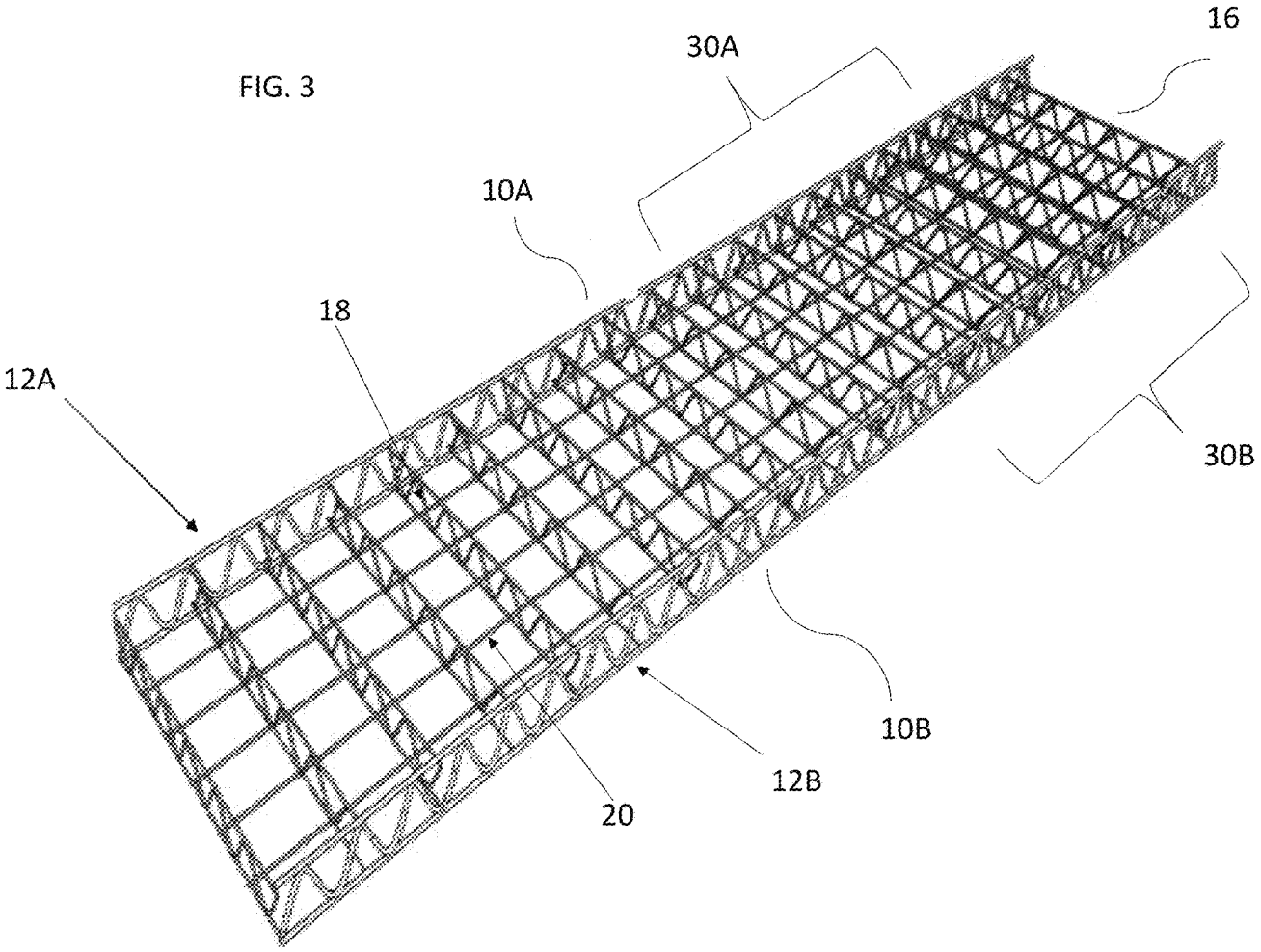
FIG. 3 illustrates a perspective view of one embodiment of an assembled space frame with a truss member is attached on each longitudinal side of the space frame.

FIG. 3 illustrates one embodiment of the assembled space frame 16, where a truss member 10A and 10B is attached to each longitudinal side 30A and 30B of the space frame 16. In this embodiment, each truss member 10A and 10B is preferably welded to the plurality of sinusoidal support members 18 at both the top and bottom support members 12A and 12B of each truss member 10A and 10B.

Figure 4:
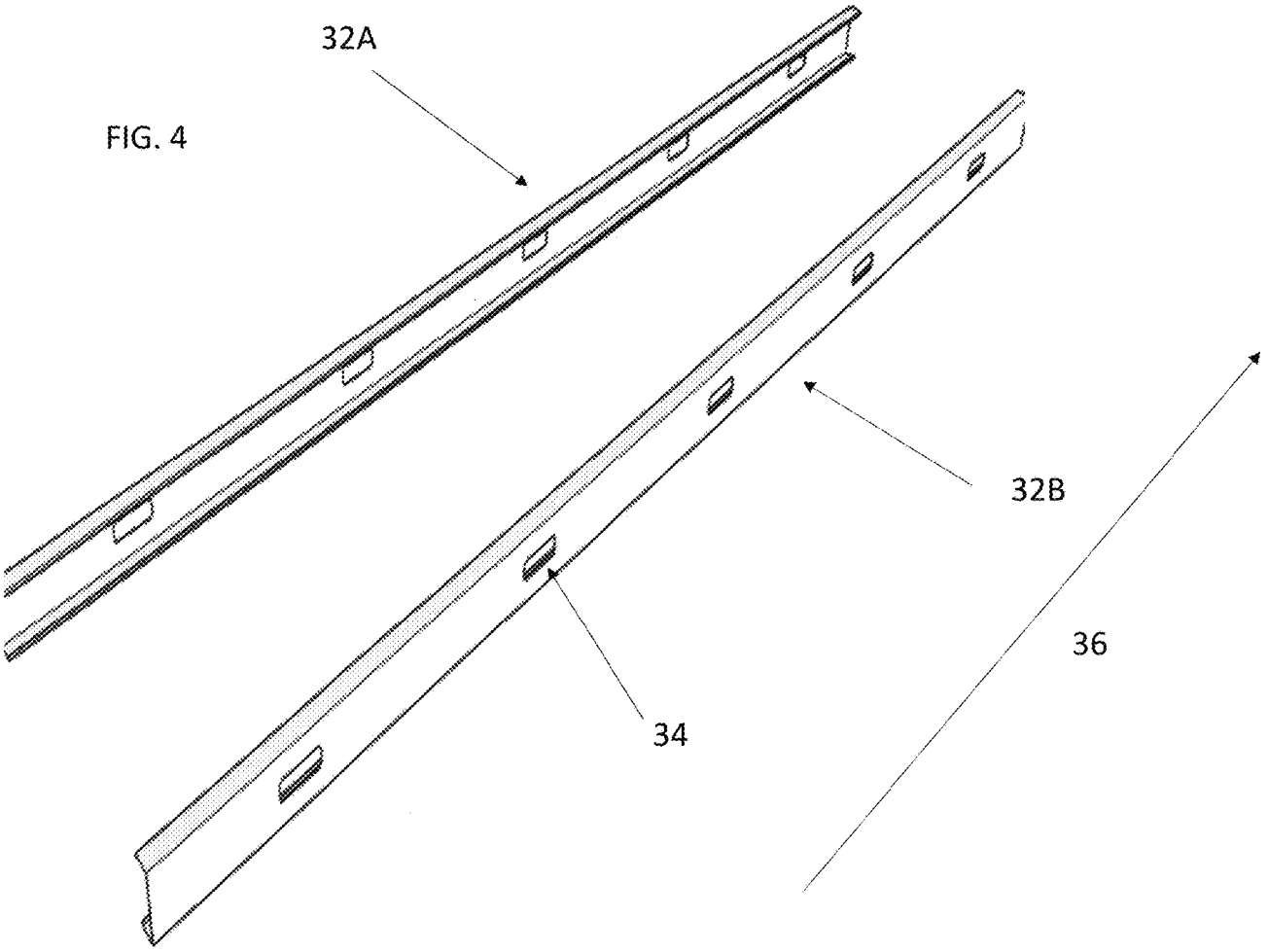
FIG. 4 illustrates a perspective view of a pair of stud members for use with the assembled space frame.

FIG. 4 illustrates a pair of stud members 32A and 32B, wherein each stud member 32A and 32B comprises a plurality of apertures 34 along the longitudinal length 36 of each stud member 32A and 32B.

Figure 5:
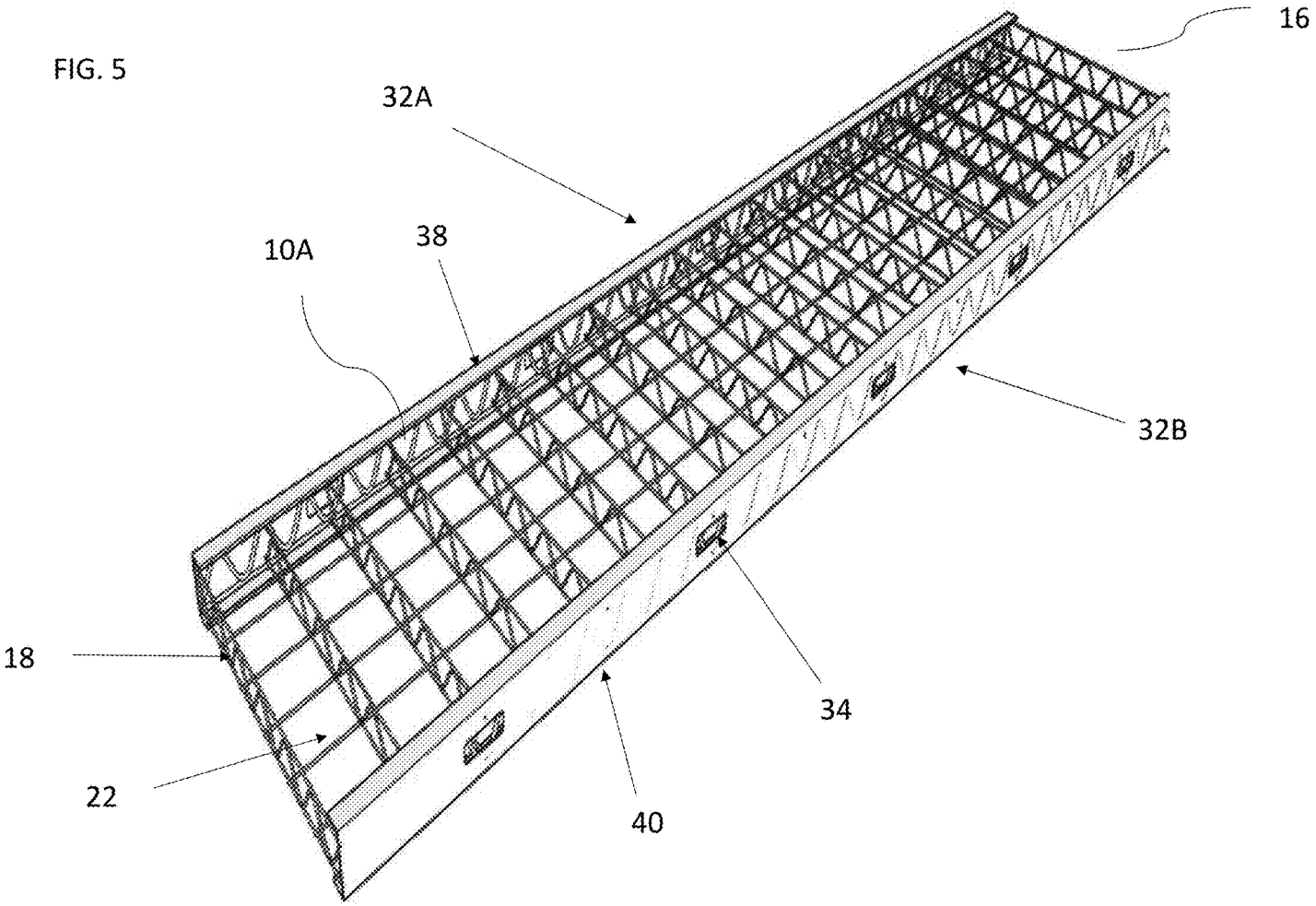
FIG. 5 illustrates a perspective view of one embodiment of the assembled space frame with a stud member attached to each longitudinal side.

FIG. 5 illustrates one embodiment of the assembled space frame 16, with both the truss members 10A and 10B, and the stud members 32A and 32B attached to the longitudinal sides 30A and 30B of the space frame 16. In this embodiment, the truss members 12A and 12B, along with the plurality of sinusoidal support members 18 are welded to each side of the stud member 32A and 32B (i.e. the side of stud member known as the web in the art). In another embodiment, the welding occurs at approximately every fifteen centimeters along the longitudinal length 36 of each stud member 32A and 32B.

Figure 6:
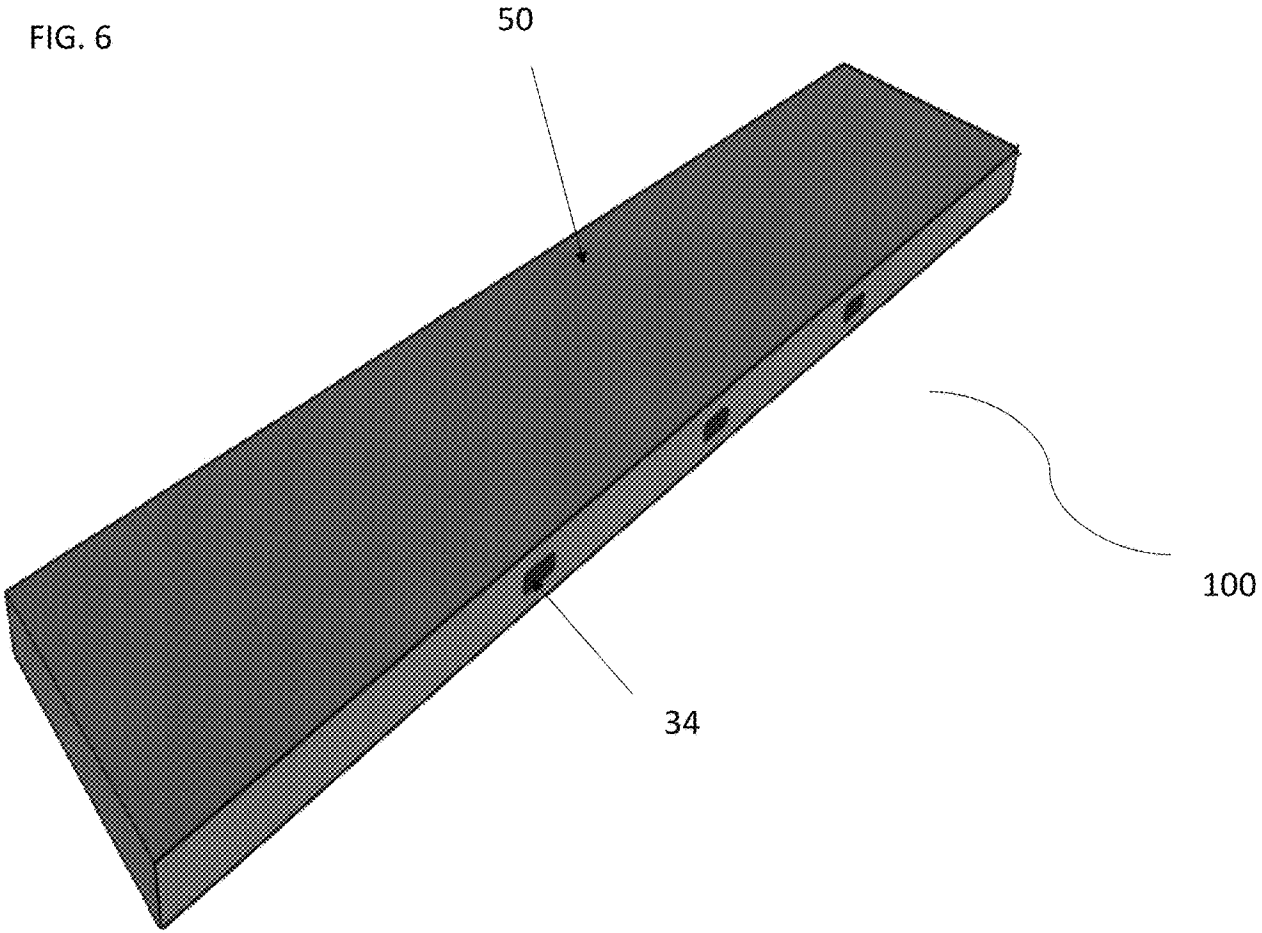
FIG. 6 illustrates a perspective view of one embodiment of a fully assembled structural panel space frame system filled and covered by a lightweight foam filler layer.

FIG. 6 illustrates one embodiment of the fully assembled structural panel 100, wherein the structural panel 100 further comprises a foam layer 50. In this embodiment the foam layer 50 may be comprised of polyurethane, polystyrene or a mix of polyurethane and minerals for fireproofing, and fills in the voids of the space frame 16 and creates an outer skin of the structural panel for installation. In one embodiment the mixture may be 70% polyurethane and 30% minerals.

Figure 7:
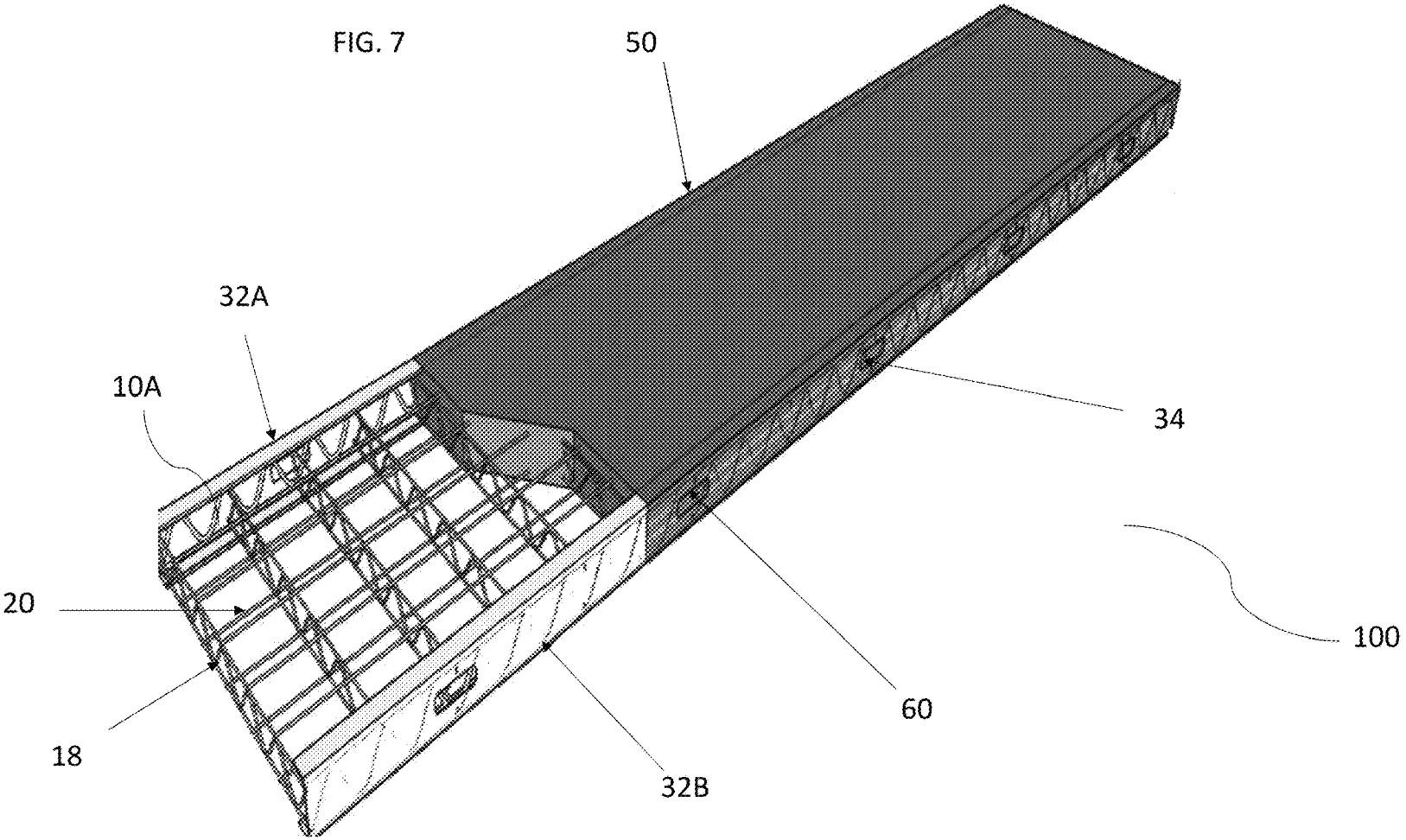
FIG. 7 illustrates a perspective cut-away view of one embodiment of the full assembled structural panel.

FIG. 7 illustrates a cut-away view of one embodiment of the structural panel 100 partially covered by foam layer 50. The assembled structural panel 100 includes a space frame assembly 16 comprises a set of truss members 10A and 10B, a plurality of sinusoidal support members 18 and a pair of stud members 32A and 32B. Additionally, there is a corresponding cavity 60 that lines up with each aperture 34 and extends in the lateral direction 20 from one stud member 32A to the other stud member 32B. In one embodiment, during the introduction of the foam layer 50 into space frame assembly 16 temporary tubes (not shown) are placed within the space frame assembly 16 to create each cavity 60. Once the foam layer has been applied and solidified, the tubes are then removed. Moreover, the truss members 10A and 10B, along with the plurality of sinusoidal support members 18 are welded to the stud members 32A and 32B to increase the strength and performance of the structural panel 100.

In certain other embodiments, the structural panel 100 may be formed of a combination of suitable material such as metal, concrete plastic, or any combination thereof. It should be understood that various alternatives to the embodiments of the disclosure described herein may be employed in practicing the disclosure. Elements of an implementation of the systems and methods described herein may be independently implemented or combined with other implementations. It is intended that the claims to follow with the utility application define the scope of the disclosure and that systems, methods, and devices within the scope of these claims and their equivalents be covered thereby.

What is claimed:

1. A structural panel configured for use in building installation comprising:

a three-dimensional space frame assembly, wherein the space frame assembly comprises:

at least two longitudinal sides;

at least one lateral side;

a plurality of sinusoidal support members arranged in a lateral direction; and a plurality of opposing reinforcing elements arranged in a longitudinal direction;

a pair of truss members, wherein one truss member in the pair is attached to each longitudinal side of the space frame assembly;

a pair of stud members, wherein one stud member is attached to each longitudinal side of the space frame assembly and a corresponding said truss member as a bracing system, each stud member comprises a plurality of apertures located along a longitudinal length thereof;

a foam layer which is provided throughout the space frame assembly, truss members, and stud members;

a plurality of first cavities, wherein each first cavity lines up with a corresponding said aperture and extends in the lateral direction from the one stud member to the other stud member; and a plurality of second cavities, wherein each second cavity extends in the longitudinal direction through a body of the panel;

wherein the structural panel possesses load bearing capacity and the truss members, sinusoidal support members, stud members, and reinforcing elements provide structural integrity and load bearing capacity independent of the foam layer.

2. The structural panel of claim 1, wherein the plurality of opposing reinforcing elements are in perpendicular orientation to the plurality of sinusoidal support members.

3. The structural panel of claim 1, wherein each truss member further comprises:

a top support member;

a bottom support member; and a sinusoidal element, wherein the sinusoidal element extends along a length of the top and bottom support members of each truss member.

4. The structural panel of claim 3, wherein each sinusoidal element is welded to the top and bottom support members wherein the sinusoidal element and the top and bottom support member come into physical contact with each other.

5. The structural panel of claim 1, wherein each sinusoidal support member further comprises:

a top support member;

a bottom support member; and a sinusoidal element wherein the sinusoidal element extends along a length of the top and bottom support members of each sinusoidal support member.

6. The structural panel of claim 5, wherein each reinforcing member further comprises:

a top reinforcing element; and a bottom reinforcing element;

wherein each top reinforcing element is in mechanical communication via welding with each top support member of each sinusoidal support member; and wherein each bottom reinforcing element is in mechanical communication via welding with each bottom support member of each sinusoidal support member.

7. The structural panel of claim 5, wherein each truss member is welded to the plurality of sinusoidal support members at both the top and bottom support members of each truss member.

8. The structural panel of claim 5, wherein the truss members and the plurality of sinusoidal support members are welded to each stud member.

9. The structural panel of claim 5, wherein the foam layer is selected from the group consisting of: polyurethane, polystyrene and a mixture of polyurethane and minerals.

10. The structural panel of claim 9, wherein the foam layer constitutes a flat surface configured to be finished on both sides of the structural panel.

* * * * *